US012686900B2

(12) United States Patent
Kim et al.

(10) Patent No.: US 12,686,900 B2
(45) Date of Patent: Jul. 21, 2026

(54) FERRITIC STAINLESS STEEL HAVING IMPROVED CORROSION RESISTANCE, AND METHOD FOR MANUFACTURING SAME

(71) Applicant: POSCO, Pohang-si (KR)

(72) Inventors: Jin-suk Kim, Pohang-si (KR); Junghyun Kong, Pohang-si (KR); Mun-soo Lee, Pohang-si (KR)

(73) Assignee: POSCO, Pohang-si (KR)

( * ) Notice: Subject to any disclaimer, the term of this patent is extended or adjusted under 35 U.S.C. 154(b) by 629 days.

(21) Appl. No.: 17/917,993

(22) PCT Filed: Oct. 14, 2020

(86) PCT No.: PCT/KR2020/014033
§ 371 (c)(1),
(2) Date: Oct. 10, 2022

(87) PCT Pub. No.: WO2021/221246
PCT Pub. Date: Nov. 4, 2021

(65) Prior Publication Data

US 2023/0144982 A1 May 11, 2023

(30) Foreign Application Priority Data

Apr. 28, 2020 (KR) ..... 10-2020-0051691

(51) Int. Cl.
*C21D 9/46* (2006.01)
*C21D 8/02* (2026.01)
(Continued)

(52) U.S. Cl.
CPC ..... *C21D 9/46* (2013.01); *C21D 8/02* (2013.01); *C21D 8/0226* (2013.01);
(Continued)

(58) Field of Classification Search
None
See application file for complete search history.

(56) References Cited

U.S. PATENT DOCUMENTS

2004/0055674 A1 3/2004 Yazawa et al.
2013/0017116 A1 1/2013 Hatano et al.
(Continued)

FOREIGN PATENT DOCUMENTS

CN 1412348 A * 4/2003
CN 103276299 A 9/2013
(Continued)

OTHER PUBLICATIONS

International Search Report dated Feb. 2, 2021 issued in International Patent Application No. PCT/KR2020/014033 (with English translation).
(Continued)

*Primary Examiner* — Jenny R Wu
(74) *Attorney, Agent, or Firm* — Morgan Lewis & Bockius LLP

(57) ABSTRACT

Disclosed are a ferritic stainless steel having improved corrosion resistance and a method for manufacturing same. The ferritic stainless steel according to an embodiment of the present disclosure includes, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities, wherein an area ratio of microdefects is 2% or less, and a sulfur (S) content in a surface film within 5 mm from the surface is 10% or less.

19 Claims, 1 Drawing Sheet

(51) Int. Cl.

| | |
|---|---|
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 8/0236* (2013.01); *C21D 8/0273* (2013.01); *C21D 8/0278* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C21D 2211/005* (2013.01)

(56) References Cited

U.S. PATENT DOCUMENTS

| | | | | |
|---|---|---|---|---|
| 2017/0175217 | A1* | 6/2017 | Nakamura | C22C 38/004 |
| 2019/0226044 | A1 | 7/2019 | Kawagoe et al. | |

FOREIGN PATENT DOCUMENTS

| | | | | | |
|---|---|---|---|---|---|
| EP | 3278887 | A1 | | 2/2018 | |
| EP | 3342895 | A1 | * | 7/2018 | C21D 1/26 |
| JP | 57137427 | A | * | 8/1982 | C21D 9/48 |
| JP | S61-69989 | A | | 4/1986 | |
| JP | S63-157886 | A | | 6/1988 | |
| JP | 2002137004 | A | * | 5/2002 | |
| JP | 2009-174036 | A | | 8/2009 | |
| JP | 2010-229488 | A | | 10/2010 | |
| JP | 2013-208638 | A | | 10/2013 | |
| KR | 20110122379 | A | * | 11/2011 | |
| KR | 20120073644 | A | * | 7/2012 | |
| KR | 10-2013-0074216 | A | | 7/2013 | |
| KR | 10-2015-0068648 | A | | 6/2015 | |
| KR | 10-2016-0143900 | A | | 12/2016 | |
| KR | 20160143900 | A | * | 12/2016 | |
| WO | 2018/003143 | A1 | | 1/2018 | |

OTHER PUBLICATIONS

The Extended European Search Report dated Dec. 11, 2024 issued in European Patent Application No. 20933238.6.

Chinese Office Action dated Apr. 20, 2023 issued in Chinese Patent Application No. 202080100181.9 (with English translation).

* cited by examiner

【FIG. 1】
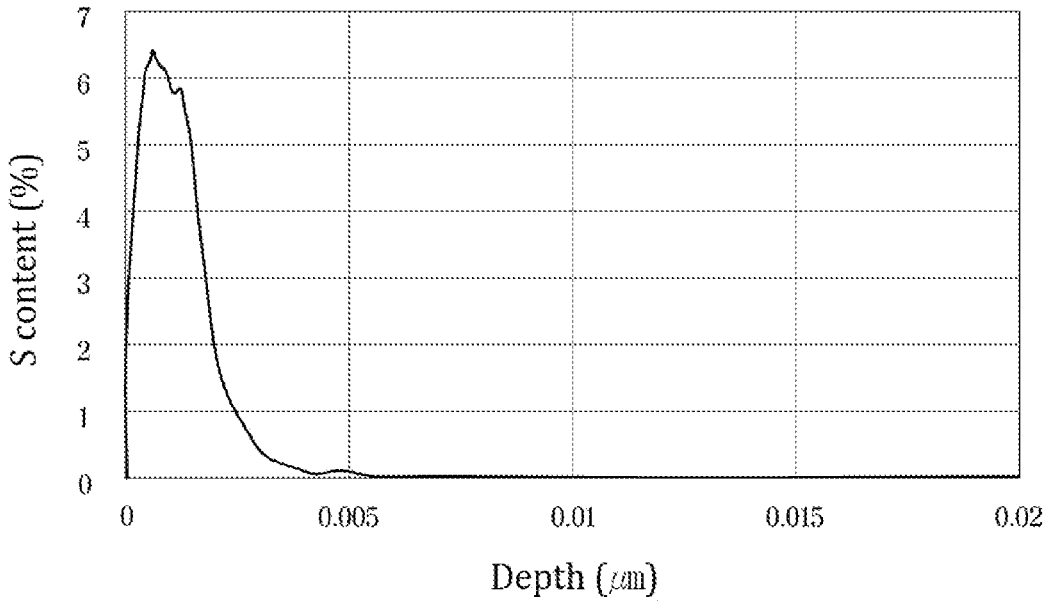
【FIG. 2】
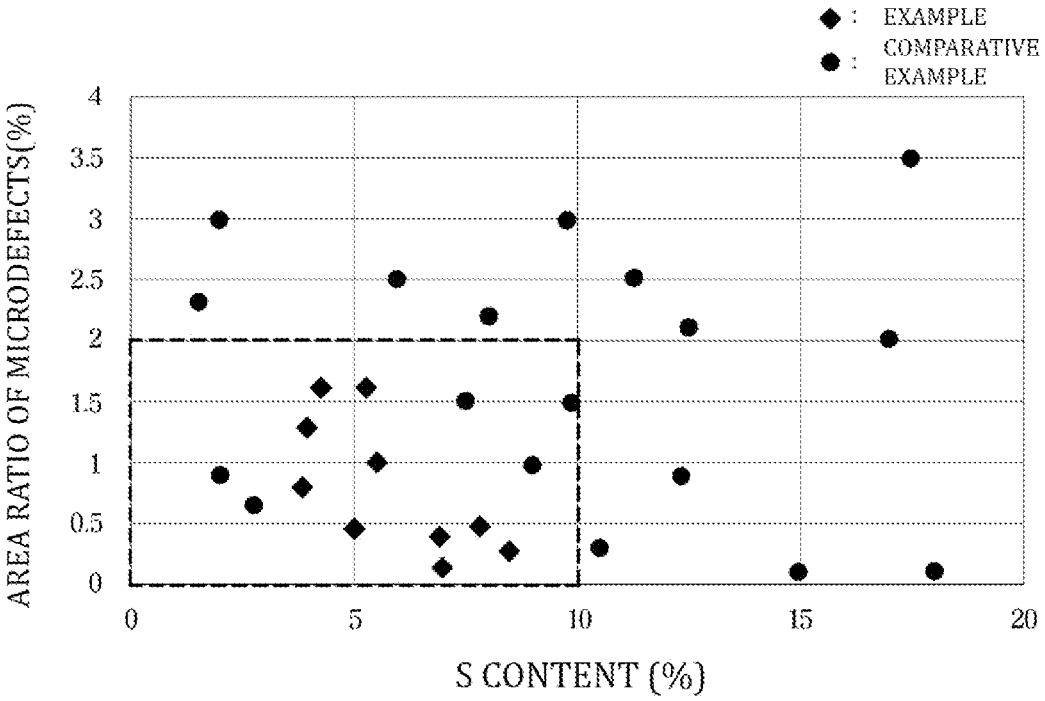

FERRITIC STAINLESS STEEL HAVING IMPROVED CORROSION RESISTANCE, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/014033, filed on Oct. 14, 2020 which claims priority to and the benefit of Korean Application No. 10-2020-0051691 filed on Apr. 28, 2020, the entire contents of which are incorporated herein by reference.

TECHNICAL FIELD

The present disclosure relates to a ferritic stainless steel having improved corrosion resistance and a method for manufacturing same, and more particularly, to a ferritic stainless steel having improved corrosion resistance with an aesthetic appearance and a method for manufacturing same.

BACKGROUND ART

Ferritic stainless steel materials have higher price competitiveness than that of austenitic stainless steel materials due to excellent corrosion resistance by using smaller amounts of expensive alloying elements and thus applied to various fields.

Meanwhile, interior/exterior decoration materials of vehicles such as molding materials require excellent aesthetic surface characteristics, bright-annealed (BA) ferritic stainless steel materials have been used therefor. Specifically, surface quality required for interior/exterior decoration materials of vehicles should have a gloss (GS 20° C.) of 1,050 or more and a distinctness of reflected image of 90 or more without occurrence of corrosion.

Gloss refers to an amount of light reflected by a surface of an object at a specular angle, as a measure that quantifies the degree of gloss of the surface of the object as a percentage with respect to a gloss of a standard sample having a constant refractive index.

Distinctness of reflected image (DOI) refers to a ratio of a difference between an amount of light reflected by a surface of an object at a specular angle and an amount of light reflected by the surface at an angle deviating from the specular angle by ±0.3°. DOI is also referred to as resolution and indicates clearness of an object. Objects having the same gloss may have different DOI values according to surface shapes of the objects and distribution and shapes of microdefects.

In general, cold-rolled ferritic stainless steel sheets for interior/exterior decoration of vehicles are obtained by skin pass rolling bright-annealed steel plates. However, there is a problem that desired clear surface quality cannot be obtained by visual observation according to conventional manufacturing methods due to microdefects remaining on the surface even when gloss and distinctness of reflected image satisfy required quality levels.

It has been found that such microdefects that deteriorate surface characteristics are caused by a lubricant remaining in concave grooves of the surface of a ferritic stainless steel during cold rolling. Also, it has been known that microdefects are caused in the case of performing cold rolling on a rough surface after hot rolling or performing cold rolling in a state where shot ball marks formed by shot blasting during hot annealing and pickling processes remains.

Therefore, it is essential to reduce microdefects on the surface of a ferritic stainless steel before final cold rolling in order to improve surface characteristics of the ferritic stainless steel.

On the other hand, although problems that microdefects of the surface deteriorate gloss and distinctness of reflected image have been disclosed in related art documents, effects of surface microdefects on corrosion resistance have not been clearly discovered.

DISCLOSURE

Technical Problem

Provided are a ferritic stainless steel having excellent corrosion resistance as well as surface characteristics by controlling surface microdefects and a S content in a surface film within 5 mm from the surface and a method for manufacturing same.

Technical Solution

In accordance with an aspect of the present disclosure, a ferritic stainless steel having improved corrosion resistance includes, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities, wherein an area ratio of microdefects is 2% or less and a S content in a surface film within 5 mm from the surface is 10% or less.

In addition, according to an embodiment of the present disclosure, the ferritic stainless steel may further include at least one of 0.01 to 2.0% of Mo, 0.1% or less (excluding 0) of Al, 1.0% or less (excluding 0) of Cu, 0.01 to 0.3% of V, 0.01 to 0.3% of Zr and 0.0010 to 0.0100% of B.

In addition, according to an embodiment of the present disclosure, microdefects having a length of 100 μm or more may be distributed at a density of 5 pieces/$mm^2$ or less.

In addition, according to an embodiment of the present disclosure, the ferritic stainless steel satisfies Expression (1) below:

$$5.12 * \text{area ratio of microdefects (\%)} + S \text{ content in the surface film (\%)} \leq 17 \quad \text{Expression (1):}$$

In accordance with another aspect of the present disclosure, a method for manufacturing a ferritic stainless steel having improved corrosion resistance, includes: hot rolling a slab comprising, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities and hot annealing the hot-rolled steel sheet; cold rolling and cold annealing the hot-rolled, annealed steel sheet twice or more by controlling a roll diameter to 70 mm or less; degreasing the cold-rolled, annealed steel sheet for 60 seconds to 120 seconds; and bright annealing the cold-rolled steel sheet, wherein surface polishing treatment is introduced after hot annealing or after primary cold rolling.

In addition, according to an embodiment of the present disclosure, the ferritic stainless steel may further include one of 0.01 to 2.0% of Mo, 0.10% or less (excluding 0) of Al, 1.0% or less (excluding 0) of Cu, 0.01 to 0.3% of V, 0.01 to 0.3% of Zr, and 0.0010 to 0.0100% of B.

In addition, according to an embodiment of the present disclosure, the cold rolling may include: primary cold rolling performed at a reduction ratio of 40% or more; and secondary cold rolling performed at a reduction ratio of 40% or more, wherein a total reduction ratio is 80% or more.

In addition, according to an embodiment of the present disclosure, the cold rolling may further include tertiary cold rolling performed at a reduction ratio of 40% or more.

In addition, according to an embodiment of the present disclosure, a re-heating temperature may be from 1050 to 1280° C., and a finishing rolling temperature is from 800 to 950° C. during the hot rolling.

In addition, according to an embodiment of the present disclosure, the surface polishing treatment may be performed by removing the surface layer by 7 μm or more using a polishing belt having a roughness of #70 mesh or more.

In addition, according to an embodiment of the present disclosure, the surface polishing treatment may be performed once or twice.

In addition, according to an embodiment of the present disclosure, the cold annealing may be performed at a temperature of 850 to 1,100° C.

In addition, according to an embodiment of the present disclosure, the bright annealing may be performed at a temperature of 850 to 1,100° C.

In addition, according to an embodiment of the present disclosure, the skin pass rolling may be performed using a work roll having an average roughness of #600 or more.

In addition, according to an embodiment of the present disclosure, the skin pass rolling may be performed twice to five times.

Advantageous Effects

According to the present disclosure, provided are a ferritic stainless steel having excellent surface characteristics and corrosion resistance by controlling the surface microdefects and the S content in the surface film within 5 mm from the surface and a method for manufacturing same.

DESCRIPTION OF DRAWINGS

FIG. 1 is a graph showing a method for measuring an S content in a surface film of ferritic stainless steels of examples according to the present disclosure and comparative examples by glow discharge optical emission spectroscopy (GD-OES).

FIG. 2 is a graph showing the relationship between a S content of the surface film and area ratio (%) of surface microdefects in examples according to the present disclosure and comparative examples.

BEST MODE

A ferritic stainless steel having improved corrosion resistance according to an embodiment of the present disclosure includes, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities, wherein an area ratio of microdefects is 2% or less and a S content in a surface film within 5 mm from the surface is 10% or less.

Modes of the Invention

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, the term "include" an element does not preclude other elements but may further include another element, unless otherwise stated.

As used herein, the singular forms are intended to include the plural forms as well, unless the context clearly indicates otherwise.

Hereinafter, embodiments of the present disclosure will be described in detail with reference to the accompanying drawings. First, a ferritic stainless steel will be described, and then a method for manufacturing the ferritic stainless steel will be described.

Microdefects are formed during hot rolling/annealing, pickling and cold rolling processes from a steel-making process due to various factors and observed in various forms such as steel-making inclusions, hot rolling defects, and oil pits and white stripes formed by non-uniform texture during cold rolling.

Specifically, microdefects are caused as a lubricant remains in concave grooves on the surface of a ferritic stainless steel during cold rolling. Alternatively, microdefects are caused by cold rolling performed on a rough surface after hot rolling or by cold rolling performed in a state where shot ball marks formed by shot blasting during hot annealing and pickling processes remains.

In this case, there is a problem in that surface characteristics and corrosion of a ferritic stainless steel cannot be obtained by visual observation.

As a result of intensive efforts to obtain both surface characteristics and corrosion resistance of ferritic stainless steels, the present inventors have found those described below.

Once formed, microdefects such as oil pits may act as starting points of corrosion, and thus it is important to minimize microdefects in terms of corrosion resistance.

Meanwhile, sulfur (S), a component of a rolling oil, remaining in the microdefects may remain in the surface film formed after bright annealing and prevent formation of a passivated layer in the case where corrosion occurs, thereby acting as a factor deteriorating corrosion resistance of a bright-annealed ferritic stainless steel.

In the present disclosure, as a result of conducting studies on various factors affecting surface characteristics, the inventors have found that corrosion resistance of a ferritic stainless steel may be improved by controlling the ratio of microdefects and the S content in the bright-annealed (BA) film formed on the surface after bright annealing. This result may be achieved by introducing a surface treatment process, controlling a roll diameter to 70 mm or less during cold rolling, and adjusting an immersion time before the bright annealing.

A ferritic stainless steel having improved corrosion resistance according to an embodiment of the present disclosure includes, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities.

Hereinafter, reasons for numerical limitations on the contents of alloying elements in the embodiment of the present disclosure will be described. Hereinafter, the unit is wt % unless otherwise stated.

The content of C is from 0.001 to 0.05%.

Carbon (C), as an interstitial solid solution strengthening element, improves strength of a ferritic stainless steel and may be added in an amount of 0.001% or more. However, when the C content is excessive, impact toughness, corrosion resistance, and workability deteriorate, and thus an upper limit thereof may be set to 0.05%.

The content of N is from 0.001 to 0.05%.

Nitrogen (N), also as an interstitial solid solution strengthening element like C, enhances strength of a ferritic stainless steel, and thus may be added in an amount of 0.001% or more. However, when the N content is excessive, N binds to aluminum or titanium to form a nitride, deteriorates ductility of a steel, and causes stretcher strain of a cold-rolled product, and thus an upper limit thereof may be set to 0.05%.

The content of Si is from 0.1 to 1.0%.

Silicon (Si) is an element serving as a deoxidizer during a steel-making process and stabilizing a ferrite phase. In the present disclosure, in order to obtain strength and corrosion resistance of a ferritic stainless steel, it is preferable to add Si in an amount of 0.1% or more. However, when the Si content is excessive, there may be a problem of deteriorating ductility and formability, and thus an upper limit thereof may be set to 1.0%.

The content of Mn is from 0.1 to 1.0%.

Manganese (Mn), as an austenite-stabilizing element, may be added in an amount of 0.1% or more. However, an excess of Mn may cause a problem of deteriorating corrosion resistance, and thus an upper limit thereof may be set to 1.0%.

The content of Cr is from 12.0 to 22.0%.

Chromium (Cr) stabilizes ferrite, as a basic element contained in stainless steels in the largest amount among the elements used to improve corrosion resistance. In the present disclosure, Cr may be added in an amount of 12.0% or more to obtain corrosion resistance by forming a passivated layer inhibiting oxidation. However, an excess of Cr may increase manufacturing costs and deteriorate formability, and thus an upper limit thereof may be set to 22.0%.

The content of Ti is from 0.01 to 1.0%.

Titanium (Ti) is an element effective on obtaining corrosion resistance of steels by preferentially binding to interstitial elements such as carbon (C) and nitrogen (N) to form precipitates (carbonitrides) to reduce amounts of solute C and solute N in the steels and inhibit formation of a Cr depletion region. In the present disclosure, Ti may be added in an amount of 0.01% or more. However, when the Ti content is excessive, Ti-based inclusions are formed causing a problem in a manufacturing process and surface defects such as scabs may be caused, and thus an upper limit thereof may be set to 1.0%.

The content of Nb is from 0.01 to 1.0%.

Niobium (Nb) is an element improving corrosion resistance by preferentially binding to interstitial elements such as carbon (C) and nitrogen (N) to form carbonitrides to reduce an amount of solute C and may be added in an amount of 0.01% or more in the present disclosure. However, an excess of Nb may increase manufacturing costs and form Laves precipitates, thereby causing problems of deteriorating formability, causing brittle fracture, and deteriorating toughness, and thus an upper limit thereof may be set to 1.0%.

In addition, according to an embodiment of the present disclosure, the ferritic stainless steel may further include at least one of 0.01 to 2.0% of Mo, 0.1% or less (excluding 0) of Al, 1.0% or less (excluding 0) of Cu, 0.01 to 0.3% of V, 0.01 to 0.3% of Zr, and 0.001 to 0.01% of B.

The content of Mo is from 0.01 to 2.0%.

Molybdenum (Mo) is an element effective on obtaining corrosion resistance, particularly pitting corrosion resistance, of steels and may be added in an amount of 0.01% or more in the present disclosure. However, an excess of Mo may increase manufacturing costs and deteriorate impact characteristics, thereby increasing the risk of breakage during processing, and thus an upper limit thereof may be set to 2.0%.

The content of Al is from 0.1% or less.

Aluminum (Al) is a strong deoxidizer and serves to lower the content of oxygen in a molten steel. However, when the Al content is excessive, sleeve defects of a cold-rolled strip occur due to an increase in nonmetallic inclusions, and thus an upper limit thereof may be set to 0.1%.

The content of Cu is 1.0% or less.

Copper (Cu) may be additionally added to improve corrosion resistance. An excess of Cu may cause a problem of deteriorating workability, and thus an upper limit thereof may be set to 1.0%.

The contents of V and Zr are from 0.01 to 0.3%, respectively.

Vanadium (V) and zirconium (Zr) are elements fixing carbon (C) and nitrogen (N) by forming carbonitrides therewith and may be added in an amount of 0.01% or more in the present disclosure to improve corrosion resistance and high-temperature strength. However, when the V content and Zr content are excessive, a problem of increasing manufacturing costs may occur, and thus an upper limit thereof may be set to 0.3%.

The content of B is from 0.001 to 0.01%.

Boron (B), as an element effective on obtaining satisfactory surface quality by inhibiting occurrence of cracks during a casting process, may be added in an amount of 0.001% or more. However, an excess of B may form a nitride (BN) on the surface of a product during an annealing/acid pickling process, thereby deteriorating the surface quality, and thus an upper limit thereof may be set to 0.01%.

The remaining component of the composition of the present disclosure is iron (Fe). However, the composition may include unintended impurities inevitably incorporated from raw materials or surrounding environments, and thus addition of other alloy components is not excluded. These impurities are known to any person skilled in the art of manufacturing and details thereof are not specifically mentioned in the present disclosure.

As described above, in order to improve corrosion resistance of a ferritic stainless steel, microdefects occurring on the surface thereof need to be reduced.

Specifically, in the ferritic stainless steel satisfying the above-described composition of alloying elements, an area ratio of microdefects may be 2% or less and microdefects having a length of 100 μm or more may be distributed at a density of 5 pieces/$mm^2$ or less in order to obtain corrosion resistance together with surface quality requirements for interior/exterior decoration materials of vehicles.

Also, the S content in a surface film formed after bright annealing needs to be minimized to improve corrosion resistance of the ferritic stainless steel. The ferritic stainless steel having improved surface characteristics according to an embodiment of the present disclosure may have a S content of 10% or less in a surface film within 5 mm from the surface.

In the present disclosure, studies have been conducted on surface factors affecting corrosion resistance to improve corrosion resistance of a ferritic stainless steel. Although it is known that surface microdefects affect corrosion resistance, effects of components contained in the surface film of a ferritic stainless steel have not been clearly found. In the present disclosure, as a result of analyzing a correlation between various components in the surface film and corrosion resistance, it has been found that sulfur (S), among the components, affects corrosion resistance and Expression (1) below has been derived.

$$5.12*\text{area ratio of microdefects (\%)}+S \text{ content in the surface film} \leq 17 \quad \text{Expression (1):}$$

Herein, the S content in the surface film means the content of S (%) contained in a surface film within 5 nm from the surface.

The present inventors have confirmed that more corrosion occurs as the area ratio of microdefects increases and the S content increases in the surface film. Specifically, in the case where a value of 5.12*area ratio of microdefects (%)+S content in the surface film (%) exceeds 17, the microdefects act as starting points of corrosion and sulfur delays formation of a passivated layer when the BA film is broken. In consideration thereof, an upper limit of the value of Expression (1) is set to 17.

Hereinafter, a method for manufacturing a ferritic stainless steel having improved corrosion resistance according to another embodiment of the present disclosure will be described.

The method for manufacturing the ferritic stainless steel having improved corrosion resistance according to an embodiment of the present disclosure includes: hot rolling and hot annealing a slab including the above-described composition of alloying elements; cold rolling and cold annealing the hot-rolled, annealed steel sheet twice or more by controlling a roll diameter to 70 mm or less; degreasing the cold-rolled, annealed steel sheet for 60 to 120 seconds; and bright annealing the cold-rolled steel sheet, wherein surface polishing is introduced after the hot annealing or primary cold rolling.

The slab including the above-described composition processed using a series of hot rolling and hot annealing, cold rolling and cold annealing, immersing, bright annealing, and skin pass rolling to produce a final product.

In order to improve both surface characteristics and corrosion resistance of a ferritic stainless steel, surface microdefects should be reduced. In the present disclosure, attempts have been made to remove surface scales and microdefects by introducing a surface treatment process and minimize occurrence of surface microdefects of a ferritic stainless steel by controlling a roll diameter during cold rolling. In addition, attempts have been made to minimize the S content contained in the BA film formed after bright annealing by controlling an immersion time before the bright annealing.

First, the slab is re-heated at a temperature of 1,050 to 1,280° C.

With respect to the conditions for hot rolling, as a re-heating temperature for the slab and a finishing rolling temperature increase, recrystallization occurs more efficiently during a hot rolling process. However, at a too high temperature, a coarse band structure is formed so that recrystallization does not smoothly proceed even after cold rolling and annealing resulting in deterioration of elongation and anisotropy, and a structure is non-uniformly recrystallized and has a non-uniform thickness during a subsequent cold rolling process so that oil is introduced into concave grooves and causes occurrence of microdefects in large quantity. Therefore, upper limits of the re-heating temperature of the slab and the finishing rolling temperature during hot rolling may be set to 1,280° C. and 950° C., respectively.

On the contrary, as the re-heating temperature and the finishing rolling temperature decrease, stored deformation energy increases during hot rolling to improve recrystallization and anisotropy during annealing. However, at too low re-heating temperature and finishing rolling temperature, sticking defects in which a material sticks to a rolling mill easily occur. Therefore, lower limits of the re-heating temperature and the finishing rolling temperature during the hot rolling may be set to 1,100° C. and 800° C., respectively.

Subsequently, the prepared hot-rolled steel sheet may be pickled and cold-rolled. According to the embodiment, the cold rolling may be performed twice or more by primary cold rolling and secondary cold rolling while controlling the roll diameter to 70 mm or less.

In order to decrease the length of microdefects formed on a surface, a diameter of a cold rolling mill needs to be reduced. As the roll diameter increases, the length of microdefects increases in the rolling direction and thus the roll diameter acts as a factor deteriorating surface characteristics by decreasing distinctness of reflected image.

In the present disclosure, attempts have been made to minimize microdefects such that the number of microdefects having a length of 100 μm or more is controlled to 5 pieces/$mm^2$ or less by controlling the roll diameter to 70 mm or less. Preferably, the roll diameter is controlled within the range of 40 to 70 mm during cold rolling.

For example, the primary cold rolling may be performed at a reduction ratio of 40% or more. Subsequently, the primarily cold-rolled steel sheet may be annealed at a temperature of 850 to 1,050° C.

Subsequently, the secondary cold rolling may be performed at a reduction ratio of 40% or more. Then, the secondarily cold-rolled steel sheet may be annealed at a temperature of 850 to 1,050° C. Thus, a total reduction ratio of the secondarily cold-rolled steel sheet may be 80% or more.

If required, the secondarily cold-rolled and annealed steel sheet may be subjected to third cold rolling at a reduction ratio of 40% or more.

The cold annealing may be performed at a temperature of 850 to 1,100° C. In the present disclosure, the cold annealing temperature may be controlled to 1,100° C. or below to prevent formation of a non-uniformly recrystallized structure with a non-uniform thickness during a subsequent cold rolling caused by formation of a coarse band structure. However, in the case where the cold annealing is performed at a too low temperature, a sufficient recrystallization effect cannot be obtained, and thus the temperature range of the cold annealing is controlled to 850° C. or higher.

Meanwhile, in order to remove non-uniform surface scales and microdefects formed after annealing, surface polishing is introduced after hot annealing or primary cold rolling according to the present disclosure.

For example, surface polishing may be performed after the primary cold rolling before the secondary cold rolling using a polishing belt having a roughness of #70 mesh or more to remove the surface layer by 7 μm or more. Such a surface polishing process may be performed once or twice in consideration of costs and productivity according to a processing load.

After conducting cold rolling and cold annealing twice or more, a bright annealing process is performed to obtain intrinsic gloss without forming oxide scales on the surface of the cold-rolled, annealed steel sheet to apply the steel sheet to interior/exterior decoration materials for vehicles.

However, as described above, sulfur (S), a component of a rolling oil used during cold rolling, remains on the surface film formed after bright annealing and prevents formation of a passivated layer in the case where corrosion occurs, and thus sulfur needs to be removed from the surface before the bright annealing.

In the present disclosure, attempts have been made to control the S content in the surface film within 5 nm from the surface to 10% or less after bright annealing by introducing a degreasing step as a pre-treatment process of the bright annealing.

In the embodiment, after performing cold rolling twice or more, the steel sheet is degreased for 60 to 120 seconds before a final bright annealing process.

There may be a problem that a cold rolling oil is not completely removed in the case where a degreasing time is less than 60 seconds, and there may be a problem that productivity may deteriorate in continuous processes in the case where the degreasing time is too long. In consideration thereof, the degreasing time before bright annealing is limited within a range of 60 seconds to 120 seconds, in the present disclosure.

In this case, an 80° C., 2.5 wt % sodium hydroxide (NaOH) solution may be used as a degreasing solution.

Subsequently, the bright annealing may be performed in a reducing atmosphere containing hydrogen or nitrogen in a temperature range of 850 to 1,100° C.

In the present disclosure, a bright annealing temperature may be controlled to 1,100° C. or below in order to prevent a structure from being non-uniformly formed and having a non-uniform thickness during a subsequent cold rolling process due to a coarse band structure formed at a too high temperature. However, in the case of performing the cold annealing at a too low temperature, sufficient processibility may not be obtained due to insufficient recrystallization, and thus the temperature range of the bright annealing is controlled to 850° C. or higher.

In the bright-annealed steel sheet obtained by introducing the degreasing step, the S content in the surface film within 5 mm from the surface may be 10% or less.

Subsequently, skin pass rolling is conducted to improve surface gloss of the ferritic stainless steel.

The skin pass rolling may be conducted using a work roller having an average roughness of #600 or more. In the case of using a work roller having an average roughness less than #600, surface gloss may decrease due to the too rough work roll, failing to obtain a desired level of gloss.

The skin pass rolling may be conducted twice to 5 times. Sufficient gloss cannot be obtained in the case of conducting skin pass rolling only once and costs may increase and productivity cannot be obtained due to a processing load in the case of conducting skin pass rolling 6 times or more.

In the final cold-rolled steel sheet that has gone through the skin pass rolling, microdefects having a length of 100 μm or more may be distributed at a density of 5 pieces/mm$^2$ or less, and an area ratio of the microdefects may be 2% or less.

As such, non-uniform surface scales and microdefects may be removed by introducing surface polishing treatment after hot annealing or primary cold rolling, and the length of the microdefects formed on the surface may be reduced by controlling the roll diameter to 70 mm or less during cold rolling. Also, factors that may deteriorate corrosion resistance are minimized by introducing the degreasing step as a pre-treatment process of bright annealing to control the S content contained in the surface film within 5 nm from the surface to 10% or less after the bright annealing.

Hereinafter, the embodiments of the present disclosure will be described in more detail with reference to the following examples.

Examples

Alloying elements including, in percent by weight (wt %), 0.02% of C, 0.02% of N, 0.4% of Si, 0.3% of Mn, 18% of Cr, 0.4% of Nb, and 1% of Mo, with the balance being Fe and inevitable impurities were melted by ingot melting to prepare a slab, and the slab was heated at 1,100° C. for 2 hours and hot-rolled. After the hot rolling, the hot-rolled steel sheet was hot-annealed at 1,000° C. for 90 seconds. Subsequently, the hot-annealed steel sheet was subjected to primary cold rolling at a reduction ratio of 40% using a roll having a diameter of 50 mm and then primary cold annealing at 1,000° C. for 90 seconds. Then, the surface of the cold-rolled, annealed steel sheet was polished once by 7 μm or more under the conditions shown in Table 1 below using a polishing belt having a roughness of #80 mesh. Subsequently, the steel sheet was subjected to secondary cold rolling at a reduction ratio of 40% using a roll having a diameter of 50 to 140 mm, secondary hot annealing at 1,000° C. for 90 seconds, and immersing in an 80° C., 2.5 wt % sodium hydroxide (NaOH) solution for 30 to 120 seconds. Then, the steel sheet was bright-annealed in a 100% hydrogen atmosphere at 1,000° C. for 60 seconds, and skin pass-rolled using a work roll having an average roughness of #600 or more, thereby preparing a final steel sheet.

In comparative examples, final steel sheets were manufactured in the same manner as in the examples, except that at least one of the conditions, i.e., the roll diameter during cold rolling, immersion time before bright annealing, and surface polishing conditions, was changed as shown in Table 1 below.

TABLE 1

| | No. of polishing | Roll diameter, during cold rolling (mm) | Degreasing time (sec) |
|---|---|---|---|
| Example 1 | Once | 70 | 120 |
| Example 2 | Twice | 50 | 60 |
| Example 3 | Once | 50 | 120 |
| Example 4 | Once | 50 | 60 |
| Example 5 | Once | 50 | 60 |
| Example 6 | Once | 50 | 60 |
| Example 7 | Twice | 50 | 60 |
| Example 8 | Twice | 50 | 60 |
| Example 9 | Twice | 50 | 60 |
| Example 10 | Twice | 50 | 60 |
| Comparative Example 1 | Twice | 50 | 30 |
| Comparative Example 2 | — | 140 | 120 |
| Comparative Example 3 | — | 140 | 120 |
| Comparative Example 4 | Once | 50 | 60 |
| Comparative Example 5 | Once | 140 | 30 |
| Comparative Example 6 | — | 140 | 30 |
| Comparative Example 7 | — | 140 | 30 |
| Comparative Example 8 | Once | 140 | 60 |
| Comparative Example 9 | Twice | 50 | 30 |
| Comparative | — | 140 | 60 |

TABLE 1-continued

| | No. of polishing | Roll diameter, during cold rolling (mm) | Degreasing time (sec) |
|---|---|---|---|
| Example 10 | | | |
| Comparative Example 11 | — | 140 | 60 |
| Comparative Example 12 | Twice | 50 | 30 |
| Comparative Example 13 | Once | 50 | 30 |
| Comparative Example 14 | — | 140 | 30 |
| Comparative Example 15 | Once | 50 | 60 |
| Comparative Example 16 | — | 140 | 60 |
| Comparative Example 17 | Once | 140 | 120 |
| Comparative Example 18 | Once | 140 | 120 |

The skin pass-rolled steel sheets were photographed using an optical microscope with a maximized light source and a magnification of 50 times and area ratios of microdefects and distribution densities of microdefects having a length of 100 μm or more were measured using an image analyzer and shown in Table 2 below.

FIG. 1 is a graph showing a method for measuring an S content in a surface film of ferritic stainless steels of examples according to the present disclosure and comparative examples by glow discharge optical emission spectroscopy (GD-OES).

As shown in FIG. 1, a peak value of sulfur (S) in the distribution of components in the depth direction from the surface was set as a representative value of the S content in the film and shown in Table 2 below.

Corrosion resistance was evaluated by the copper accelerated acetic acid-salt spray test using a solution prepared by adding a mixed solution of 0.26 g/L copper chloride ($CuCl_2 \cdot 2H_2O$) and acetic acid ($CH_3COOH$) to 50 g/L sodium chloride (NaCl), as a test solution, and occurrence of corrosion is shown in Table 2 below.

TABLE 2

| | Area ratio of micro-defects (%) | Distribution density of microdefects having length of 100 μm or more (pieces/mm$^2$) | S content in film (%) | Corro-sion |
|---|---|---|---|---|
| Example 1 | 0.794 | 0.5 | 3.88 | X |
| Example 2 | 0.394 | 0 | 6.95 | X |
| Example 3 | 1.282 | 1.3 | 3.96 | X |
| Example 4 | 1.600 | 1.7 | 4.26 | X |
| Example 5 | 1.600 | 1.56 | 5.26 | X |
| Example 6 | 1.00 | 0.85 | 5.54 | X |
| Example 7 | 0.47 | 0 | 7.80 | X |
| Example 8 | 0.45 | 0 | 5.00 | X |
| Example 9 | 0.25 | 0 | 8.51 | X |
| Example 10 | 0.12 | 0 | 6.98 | X |
| Comparative Example 1 | 0.10 | 0 | 15 | ○ |
| Comparative Example 2 | 3.00 | 21 | 2 | ○ |
| Comparative Example 3 | 2.30 | 11 | 1.50 | ○ |
| Comparative Example 4 | 1.50 | 1.80 | 9.89 | ○ |
| Comparative Example 5 | 0.89 | 5.50 | 12.35 | ○ |

TABLE 2-continued

| | Area ratio of micro-defects (%) | Distribution density of microdefects having length of 100 μm or more (pieces/mm$^2$) | S content in film (%) | Corro-sion |
|---|---|---|---|---|
| Comparative Example 6 | 2.50 | 10 | 11.30 | ○ |
| Comparative Example 7 | 2.10 | 12 | 12.50 | ○ |
| Comparative Example 8 | 0.98 | 6.10 | 9 | ○ |
| Comparative Example 9 | 0.30 | 0 | 10.50 | ○ |
| Comparative Example 10 | 2.50 | 21 | 6 | ○ |
| Comparative Example 11 | 3.00 | 25 | 9.80 | ○ |
| Comparative Example 12 | 0.10 | 0 | 18 | ○ |
| Comparative Example 13 | 2.00 | 3.20 | 17 | ○ |
| Comparative Example 14 | 3.50 | 12 | 17.50 | ○ |
| Comparative Example 15 | 1.50 | 1.50 | 7.50 | ○ |
| Comparative Example 16 | 2.20 | 1.90 | 8 | ○ |
| Comparative Example 17 | 0.654 | 5.1 | 2.76 | ○ |
| Comparative Example 18 | 0.902 | 6.4 | 2.01 | ○ |

FIG. 2 is a graph showing the relationship between the S content of the surface film and the area ratio (%) of surface microdefects in examples according to the present disclosure and comparative examples.

Referring to FIG. 2 and Table 2, area ratios of microdefects exceeded 2% in Comparative Examples 2, 3, 6, 7, 10, 11, 14, and 16 in which surface polishing was not performed and the roll diameter exceeded 70 mm during cold rolling.

In Comparative Examples 5 and 8, although the area ratios of microdefects were 2% or less by performing surface polishing, the S contents contained in the film were high after bright annealing because the degreasing times were not sufficient.

In Comparative Examples 4, 13, and 15, although the area ratios of microdefects were 2% or less by performing surface polishing and conducting cold rolling using a roll having a diameter of 70 mm or less, the S contents contained in the film were high after bright annealing because the degreasing times were not sufficient.

In Comparative Examples 1, 9, and 12, although the area ratios of microdefects were 2% or less by performing surface polishing twice and conducting cold rolling using a roll having a diameter of 70 mm or less, the S contents contained in the film were high after bright annealing because the degreasing times were not sufficient.

In Comparative Examples 17 and 18, although the area ratios of microdefects and the S contents in the film after bright annealing were satisfied, corrosion occurred because the distribution density of microdefects having a length of 100 μm or more exceeded 5 pieces/mm$^2$.

On the contrary, in the ferritic stainless steels according to Examples 1 to 10, in which the surface polishing treatment was introduced once or twice after primary cold rolling, cold rolling was conducted using a roll with a diameter of 70 mm or less, and degreasing was performed for 60 to 120 seconds before bright annealing, the area ratios of microdefects were 2% or less, and the distribution densities of microdefects having a length of 100 μm or more were 5 pieces/mm$^2$ or less, and the S contents in the film after bright annealing were 10% or less. Therefore, it was confirmed that corrosion did not occur in Examples 1 to 10 in corrosion resistance evaluation.

According to the above-described embodiment, a ferritic stainless steel having improved corrosion resistance may be manufacturing by minimizing occurrence of surface microdefects of the ferritic stainless steel by primarily introducing surface polishing treatment and controlling the roll diameter during cold rolling and by adjusting the S content in the BA film formed after bright annealing by controlling the immersion time before the bright annealing.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The ferritic stainless steel according to the present disclosure may be applied to interior/exterior decoration materials of vehicles such as moldings materials due to excellent surface characteristics and corrosion resistance.

The invention claimed is:

1. A ferritic stainless steel comprising, in percent by weight (wt %), 0.001 to 0.05‰ of C, 0.001 to 0.05‰ of N, 0.1 to 1.00% of Si, 0.1 to 1.0‰ of Mn, 12.0 to 22.0‰ of Cr, 0.01 to 1.0‰ of Ti, and 0.01 to 1.0‰ of Nb, with the balance being Fe and inevitable impurities, wherein an area ratio of microdefects is 2‰ or less, wherein a distribution density of microdefects having a length of 100 μm or more is 5 pieces/mm$^2$ or less, and wherein a sulfur (S) content in a surface film within a depth of 5 nm from the surface of the stainless steel is 10 wt % or less.

2. The ferritic stainless steel according to claim 1, further comprising at least one of 0.01 to 2.0% of Mo, 0.1% or less (excluding 0) of Al, 1.0% or less (excluding 0) of Cu, 0.01 to 0.3% of V, 0.01 to 0.3% of Zr and 0.0010 to 0.0100% of B.

3. The ferritic stainless steel according to claim 1, wherein the ferritic stainless steel satisfies Expression (1) below:

$$5.12 \times A + S < 17, \quad \text{Expression (1):}$$

wherein A is the area ratio of microdefects (%), and wherein S is the sulfur content in the surface film within the depth of 5 nm from the surface of the stainless steel (wt %).

4. The ferritic stainless steel according to claim 1, wherein the area ratio of is 1.6% or less.

5. The ferritic stainless steel according to claim 1, wherein the area ratio of is 1.0% or less.

6. The ferritic stainless steel according to claim 1, wherein the distribution density of microdefects having a length of 100 μm or more is 1.7 pieces/mm$^2$.

7. The ferritic stainless steel according to claim 1, wherein the distribution density of microdefects having a length of 100 μm or more is 0.5 pieces/mm$^2$.

8. The ferritic stainless steel according to claim 1, wherein the distribution density of microdefects having a length of 100 μm or more is 0.85 pieces/mm$^2$.

9. A method for manufacturing the ferritic stainless steel of claim 1, the method comprising: hot rolling a slab comprising, in percent by weight (wt %), 0.001 to 0.05% of C, 0.001 to 0.05% of N, 0.1 to 1.0% of Si, 0.1 to 1.0% of Mn, 12.0 to 22.0% of Cr, 0.01 to 1.0% of Ti, and 0.01 to 1.0% of Nb, with the balance being Fe and inevitable impurities to form a hot rolled steel sheet and hot annealing the formed hot-rolled steel sheet; cold rolling and cold annealing the hot-rolled, annealed steel sheet twice or more by controlling a roll diameter to 70 mm or less; degreasing the cold-rolled, annealed steel sheet for 60 seconds to 120 seconds; and bright annealing the cold-rolled steel sheet, wherein surface polishing treatment is introduced after hot annealing or after primary cold rolling, and performed once or twice; thereby producing the ferritic stainless steel of claim 1.

10. The method according to claim 9, wherein the ferritic stainless steel further comprises one of 0.01 to 2.0% of Mo, 0.10% or less (excluding 0) of Al, 1.0% or less (excluding 0) of Cu, 0.01 to 0.3% of V, 0.01 to 0.3% of Zr, and 0.0010 to 0.0100% of B.

11. The method according to claim 9, wherein the cold rolling comprises:

primary cold rolling performed at a reduction ratio of 40% or more; and secondary cold rolling performed at a reduction ratio of 40% or more, wherein a total reduction ratio is 80% or more.

12. The method according to claim 9, wherein the cold rolling further comprises tertiary cold rolling performed at a reduction ratio of 40% or more.

13. The method according to claim 9, wherein a re-heating temperature is from 1050 to 1280° C., and a finishing rolling temperature is from 800 to 950° C. during the hot rolling.

14. The method according to claim 9, wherein the surface polishing treatment is performed by removing the surface layer by 7 μm or more from the surface of the steel sheet using a polishing belt having a roughness of #70 mesh or more.

15. The method according to claim 9, wherein the cold annealing is performed at a temperature of 850 to 1100° C.

16. The method according to claim 9, wherein the bright annealing is performed at a temperature of 850 to 1100° C.

17. The method according to claim 9, further comprising a skin pass rolling step performed using a work roll having an average roughness of #600 mesh or more.

18. The method according to claim 17, wherein the skin pass rolling is performed twice to five times.

19. The ferritic stainless steel according to claim 1, wherein the sulfur (S) content in the surface film within a depth of 5 nm from the surface of the stainless steel is 5 wt % or less.

* * * * *